United States Patent [19]

Vickery

[11] 3,933,002

[45] Jan. 20, 1976

[54] SKATING RINK

[76] Inventor: Earle R. Vickery, 101 Merrick St., Worcester, Mass. 01609

[22] Filed: June 17, 1974

[21] Appl. No.: 479,818

[52] U.S. Cl. ..... 62/56; 62/235; 4/177
[51] Int. Cl.[2] ..... F25D 1/00; A63C 19/10
[58] Field of Search ..... 62/235, 56; 4/177

[56] References Cited

UNITED STATES PATENTS

| | | | |
|---|---|---|---|
| 2,616,096 | 11/1952 | Hasselquist | 4/177 |
| 3,012,596 | 12/1961 | Skolout | 62/235 |
| 3,721,418 | 3/1973 | Vincent | 62/235 |
| 3,797,049 | 3/1974 | DeSanto | 4/177 |
| 3,808,831 | 5/1974 | Landry | 62/235 |

*Primary Examiner*—William J. Wye
*Attorney, Agent, or Firm*—Norman S. Blodgett; Gerry A. Blodgett

[57] ABSTRACT

A skating rink comprising a rigid wall forming the periphery of a closed area, and a sheet, spread over the area and the wall, to form a water container. The wall is formed of elongated flexible tube of plastic sheet which is placed in a peripheral configuration and then filled with space-filling, rigid material, either water, which is allowed to freeze, or formed-in-place plastic foam. The sheet is held in place either by tucking its edges under the wall or by wire clips which hold the sheet and wall together. A plastic foam blanket can be used to reduce puncturing of the wall.

6 Claims, 2 Drawing Figures

SKATING RINK

BACKGROUND OF THE INVENTION

Ice skating is one of the most popular winter sports in the world. Its popularity is attested to by the commercial success of indoor rinks that extend the skating season through the summer. In countries throughout the world, from the first real freeze until the ice becomes dangerously thin, lakes and ponds are filled with children and adults enjoying the sport. The fact that skating is good exercise, is low in cost, and is a pleasant, sociable activity, have all contributed to its popularity. The sport is, however, deeply burdened with the ever-present specter of death. Every year, large numbers of people, especially young children, fall through the thin ice on ponds and drown before they can be rescued. This danger results not only because constant supervision of natural bodies of water is impossible, but also because good ice requires a dangerous depth in order that vegetation doesn't come through the surface.

In order to eliminate this danger causing condition, numerous ideas for shallow back-yard skating rinks have developed. The most obvious possibility is a permanent installation similar to a swimming pool. Such a construction is expensive and takes up yard space all year long. Several patents for portable wading pools and skating rinks have appeared. The standard children's wading pool design as shown in the patents of Alvarez (U.S. Pat. No. 2,443,440) and of Nail (U.S. Pat. No. 3,001,207) have the disadvantage that its inflated walls have a life expectancy of one skate puncture. Also concept of pre-formed floor and wall structure which is necessary in such a container does not allow change in size and shape for maximum utilization of yard space. Similar observations apply to the design of Hasselquist (U.S. Pat. No. 2,616,096) in which the walls are held up by water pressure. Patents which are specifically directed toward portable skating rinks include Owen (U.S. Pat. No. 2,907,362). Johnson (U.S. Pat. No. 2,996,896), and Skolout (U.S. Pat. No. 3,012,596). These inventions all involve various rigid wall structures which support a flexible liner. The problem with these ideas is that a wall structure which is large enough to form a good sized rink and strong enough to support the ice, is expensive and too bulky to sell from a store shelf. Additionally, the wall itself requires considerable time and effort to construct.

These and other difficulties experienced with the prior art devices have been obviated in a novel manner by the present invention.

It is, therefore, an outstanding object of the invention to provide a skating rink in which dangerous conditions such as deep water, and sharp projections have been eliminated.

Another object of this invention is the provision of a skating rink which is suitable for use in home yards.

A further object of the present invention is the provision of a skating rink which is easy and quick to assemble.

Another object of this invention is the provision of a skating rink which is inexpensive to produce and can be formed into a small, compact package.

It is another object of the instant invention to provide a skating rink which is rugged and suited for demanding use.

With these and other objects in view, as will be apparent to those skilled in the art, the invention resides in the combination of parts set forth in the specification and covered by the claims appended hereto.

SUMMARY OF THE INVENTION

In general, the present invention consists of a portable skating rink involving a tubular wall filled with a rigid material, the wall forming the periphery of a closed geometric figure. The rink also includes a flexible, water-proof sheet which is spread over the walls to form a liquid container. The container can be filled with water and allowed to freeze. The rigid material in the walls may be water that is allowed to freeze or formed-in-place plastic foam. Clips may be used to hold the sheet in place and resilient blankets may be used to protect the wall.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
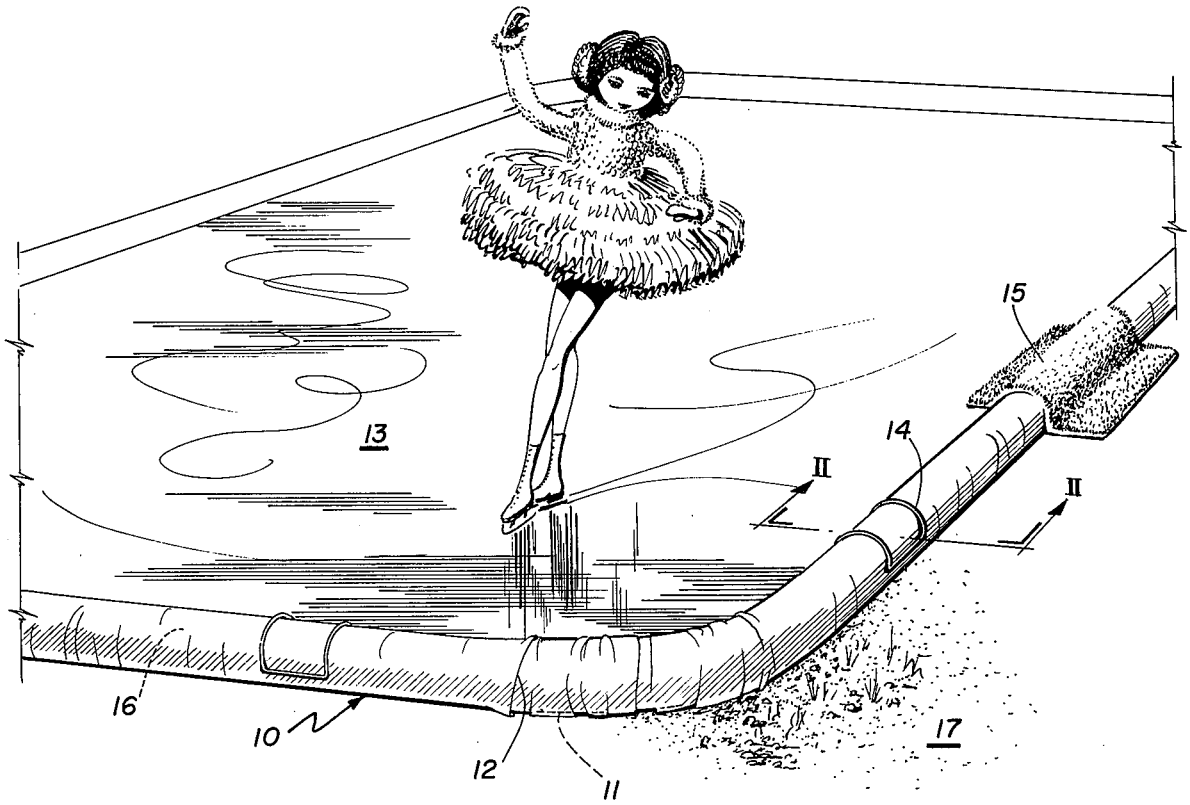
FIG. 1 is a perspective view of a portable skating rink embodying the principles of the present invention.

Referring first to FIG. 1, wherein are best shown the general features of the invention, the skating rink, indicated generally by the reference numeral 10, is shown as including a tubular wall 11 which forms the periphery of a closed geometric figure and a plastic sheet 12 which forms a liner within the walled figure. The wall 11 is formed of an elongated tube of thin plastic sheet. In flat condition a 1 foot wide, 48 foot long tube would be suitable for 144 square foot rink. The open ends of the tube can be sealed in several ways but the preferred method uses wire ties as used to close plastic bags. The ends of the wall are lapped over to enclose an area. The fact that the wall does not have to be formed of a continuous tube not only reduces the cost of the tube and makes a convenient access port to the interior of the tube, but also allows great flexibility in the size and shape of the rink. Once the rink is placed in a desired figure, the tube is filled with a rigid space-filling component 16 which might be ice or plastic foam.

The sheet 12 or liner is formed of thin plastic film and is of sufficient area to allow some variation in the scope of the rink. Wire clips 14 may be provided, which partially surround the wall to hold the sheet 12 on the wall 11. Resilient blankets 15, preferably of foamed plastic, may be provided to protect portions of the wall from puncture.

The use and operation of the invention will now be readily understood in view of the above description. An area of generally horizontal ground 17 is chosen and the empty tube wall 11 layed out in the desired shape. The tube 11 is then filled with a rigid space filling substance 16. One method is to fill the tube with water and allow the water to freeze. The water filling can be accomplished by sealing one end of the tube and feeding the water into the other end. A more expensive but more permanent material is formed-in-place plastic foam. Any of the several commercially available sources of foaming plastic can be used in this application, but the most convenient is a form in which the plastic expands upon exit from the nozzle of a pressurized can. The foamable material can be injected into the tube either through the end and with subsequent movement of the foam plugs down the tube, or by placing the nozzle through the small holes along the tubes length.

Figure 2:
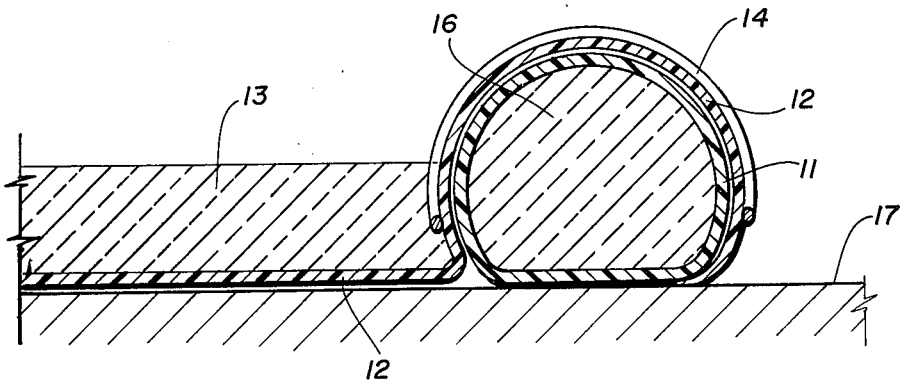
FIG. 2 is a sectional view of the rink taken on the line II—II of FIG. 1.

Once the wall is filled and formed into a closed geometric figure, the sheet 12 is placed over the figure and walls, with the edges of the sheet extending beyond the walls. As shown in FIG. 2, the sheet 12 is held against the wall 11 either by tucking the edge under the outside of the wall or by wire clips 14 which grasp the wall. The resulting structure forms a liquid container which can be filled with water 13. When the water is frozen, the resulting ice provides the skating surface. The placing of plastic foam blankets at entrance points to reduce the cutting effect of the skates, completes the skating rink.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A skating rink, comprising:

a. a flexible tube formed of sheet plastic and containing a rigid material, the tube being laid out on a horizontal surface to form the periphery of a closed geometric figure, and b. a flexible, water-proof sheet laid out over the closed geometric figure and extending beyond its periphery, thereby forming a liner of a structure capable of containing a liquid.

2. A skating rink as recited in claim 1 wherein, the rigid material is ice.

3. A skating rink as recited in claim 1 wherein, the rigid material is formed-in-place foamed plastic.

4. A skating rink as recited in claim 1 wherein, resilient clips are used to hold the sheet against the tube.

5. A skating rink as recited in claim 1 wherein, a portion of the tube is covered with a thick, resilient blanket.

6. A method of forming a skating rink, comprising the steps of:

a. forming a flexible tube into the periphery of a closed geometric figure on a horizontal surface, b. placing a material in the tube, c. causing the material to fill the tube and form a rigid mass, d. covering the closed figure with a water resistant sheet to form a liquid holding structure, and e. placing water in the structure, f. causing the water to freeze.

* * * * *